US008702462B1

(12) United States Patent
Klokow et al.

(10) Patent No.: US 8,702,462 B1
(45) Date of Patent: Apr. 22, 2014

(54) LONGITUDINALLY REINFORCED ELLIPTICALLY CONTOURED WAVERIDING SYSTEM

(75) Inventors: Jonathan Klokow, Fort Lauderdale, FL (US); Jason Klokow, Fort Lauderdale, FL (US)

(73) Assignee: Bevelboard Surfboards Company, Inc., Fort Lauderdale, FL (US)

( * ) Notice: Subject to any disclaimer, the term of this patent is extended or adjusted under 35 U.S.C. 154(b) by 527 days.

(21) Appl. No.: 12/915,567

(22) Filed: Oct. 29, 2010

Related U.S. Application Data

(60) Provisional application No. 61/258,304, filed on Nov. 5, 2009.

(51) Int. Cl.
*B63B 35/79* (2006.01)

(52) U.S. Cl.
USPC ..... 441/65; 441/74

(58) Field of Classification Search
USPC ..... 441/65, 74, 79; D21/760, 769, 770, D21/801, 803, 809
See application file for complete search history.

(56) References Cited

U.S. PATENT DOCUMENTS

| | | | | | |
|---|---|---|---|---|---|
| 3,337,886 | A | * | 8/1967 | Ekstrom | 441/74 |
| 4,028,761 | A | * | 6/1977 | Taylor | 441/65 |
| D276,359 | S | * | 11/1984 | Churchill | D21/769 |
| 4,619,619 | A | * | 10/1986 | Muse, Jr. | 441/65 |
| 4,669,992 | A | * | 6/1987 | Morris | 441/65 |
| 4,872,861 | A | * | 10/1989 | Gaudin | 441/79 |
| 5,257,953 | A | * | 11/1993 | Gillis | 441/74 |
| D347,873 | S | * | 6/1994 | Lohn | D21/803 |
| 5,700,174 | A | * | 12/1997 | Churchill et al. | 441/65 |
| 5,713,773 | A | * | 2/1998 | Churchill | 441/66 |
| 5,934,961 | A | * | 8/1999 | Mehrmann et al. | 441/65 |
| 7,074,098 | B1 | * | 7/2006 | Acosta, Jr. | 441/65 |

* cited by examiner

*Primary Examiner* — Ajay Vasudeva
(74) *Attorney, Agent, or Firm* — H. John Rizvi; Gold & Rizvi, P.A.

(57) ABSTRACT

The present invention is a longitudinally reinforced wave-riding board comprising an elongated body having an elliptically shaped deck surface for supporting a surfer. The deck comprises a recessed area with a longitudinal ridge that segments the recessed area into two substantially equal recessed sections. A fin extends downwardly from a bottom surface of the wave-riding board, and one or more longitudinal stringers strengthen the structure of the board.

14 Claims, 4 Drawing Sheets

LONGITUDINALLY REINFORCED ELLIPTICALLY CONTOURED WAVERIDING SYSTEM

CROSS-REFERENCE TO RELATED APPLICATION

This application claims the benefit of U.S. Provisional Patent Application Ser. No. 61/258,304, filed on Nov. 5, 2009, which is incorporated herein in its entirety.

FIELD OF THE INVENTION

The present invention relates generally to wave riding devices, and more particularly to surfboards for gliding on water having centrally-located bevels and a longitudinally oriented stiffening element integrated into the core for mechanical strengthening of the board. Even more particularly, the present invention relates to a new and improved wave-riding device, including an elliptically contoured area cut into the deck and stiffening elements with which the general performance of traditional surfboards is clearly improved, as will be explained in detail below.

DESCRIPTION OF THE PRIOR ART

Surfboards, and the sport of surfing, are believed to have originated in Polynesia as early as A.D. 400. The Polynesians brought the sport with them when they settled in Hawaii. In ancient times, surfing was not only a recreational activity but also an art related to spiritual affairs. For example, for Hawaiian people, surfing was a means for resolving conflicts and training for the Hawaiian chiefs. The people of Hawaii have been surf riding for centuries. The first famous witness of these early surfing activities was Captain Cook. Captain Cook witnessed natives surfing on solid wooden surfboards when he visited the Hawaiian Islands in 1777, and his diaries are the first official documentation describing the art of surfing.

In accordance with these historic documents, these boards were 77-200 pound 10-16 foot long, made of solid redwood, usually using Wili Wili, the Ula or the Koa tree's wood. The longer the board, the higher the social ranking, as they were used to establish noblemen and chief social status. The 'Olo' surfboard was ridden by the Chiefs or the noblemen usually between 14-16 feet and the 'Alaia' surfboard was between 10-12 feet in length and ridden by regular people. Many of these ancient surfboards dating back to some 230 years are displayed in the Bishop Museum in Honolulu, Hi. These solid boards that allowed multiple riders were used until the late 1930s.

Spanning over 100 years of surfing history, there were significant changes in surfboard design and structure, from the above cited centuries-old hardwood boards of the Hawaiian Islands to the innovative foam shapes. The first big challenge in the surfboard design history was reducing the weight. As explained above, the first boards were too heavy and had too little buoyancy, besides the fact that they had no fins and no rocker. The first logical step in reducing its weight was taken by one of the most influential and important figures in the history of surfing, a surfer also a national swimming champion, inventor, author and actor named Tom Blake (1902-1994). Using new materials and techniques, including the use of marine plywood and waterproof glues, he built the first hollow surfboard using a wooden framework covered with plywood and then varnished.

The invention was a huge hit and hollow surfboards soon replaced the old solid surfboards, basically because they were much lighter (around 40-45 lbs) and easier to handle. Still the shapes of hollow surfboards were similar to solid boards which gave them poor performance. These hollow-core surfboards dominated the surfing world until the late 1940's.

The next major change in surfboard design was the invention of the surfboard rocker (lengthwise curvature of a surfboard) which could be credited to the father of the modern surfboard, Bob Simmons (1919-1954). The surfboard rocker was one of the most important design features on a surfboard, since it has a great influence on the water flow and even small changes make a difference.

Another advance was the incorporation of a fin on the bottom surface of the surfboard. The surfboard fin prevents the surfboard from sliding sideways on the wave, and also allows surfers to direct the board and keep it stable. The first fins were more like keels and only one fin per board was included. During the 70's, two fins were added to the surfboard tail which allowed surfers to make more flowing carves. During the 80's, a third fin was included positioning it centrally behind the twin fins, defining what is called the 'thruster'. This three-fin set up allows smooth carving turns, gives control over the surfboard and provides drive on the wave. Another fin innovation was the removable fin system, developed in the late 90's. The removable fin system allows the fins to be taken from the surfboard to be transported and even more important—to replace your fins with different fins that can alter the riding characteristics of the surfboard.

The introduction of polymeric materials meant that strong, light, waterproof modern surfboards could be built. At first, balsa wood (very light wood) was used but was later replaced with polyurethane foam that is still used today. Another change was making the boards shorter. This shorter length and the thruster fin set up paved way for the modern style of performance surfing. Although various other materials and techniques have been tried (including epoxy/Styrofoam-based materials), most modern surfboards were made in basically the same way as they were 30 years ago, using polyester resin to cover a shaped polyurethane foam core.

Nowadays, there are many different types of surfboards. Some of the most common types are:

Shortboard: Shortboards range in length from 5' to 7'. They have nose rocker (an upturned nose) for avoiding burying the tip under water, and possess two to four fins that allow for quick, radical turns. They are called shortboards because they are shorter and narrower than longboards. This board is used to perform quick maneuvers on waves and is also called Thruster.

Longboard: The longboard dates back to ancient Hawaiian nobility, and today is ridden by surfers of all ages, shapes, and skill levels. The longboard surfboard ranges in length from 8' to 10'6" and is ridden from the tail (back section of the board) all the way to its nose. The predominant fin configuration is either one or three fins. The nose is rounded and is also called Malibu.

Egg: They look like stubby, rounded, hybrid longboards. Common in smaller surf, these boards are ideal for having fun and are a good choice for beginners. Their width makes them pretty stable and works great on small waves.

Fish: The fish surfboard gets its name from its fish-like profile. It is shorter and wider than most shortboards and looks a bit stubbier as a result. Fish surfboards typically are equipped with two to three fins and are extremely agile in small- to medium-sized surf. The boards are usually between 4'8" and 6'0".

Gun: It is used to paddle big waves; usually between 7'2" in length to over 12'. These boards are tested by serious surfers in serious waves and are specially designed to help the fully committed surfer drop into monster waves quickly. Once the big wave gun is in the wave, its narrow tail and nose help the surfer maintain the speed and control necessary to navigate giant swells.

For choosing a surfboard, some features to consider are: Length; Thickness; Width; Flexibility; Number of fins; Removable fins; Color; Flat tail; Round tail; Pointed nose or Round nose. Although the shape is arguably the most important factor in board performance, other physical properties such as weight, center of mass, torsional and longitudinal rigidity are significant factors which must be controlled to allow the surfer maximum speed and control of the board. This is the reason why the present invention is more focused on impacting the board's weight and the center of mass than on the materials used or the number of fins included.

There are no records for wave-riding devices having elliptically contoured bevels with domed center cut into the deck in the market or literature and only few about reinforcement systems included in the surfboard's body. For example, a surfboard comprising a multi-layered laminated composite foam core coupled with stiffening elements for mechanical strengthening of the board is known. The composite foam core comprises laminates of a polyolefin foam base and stiffening elements composed of substantial polymer foam and has considerably higher compressive strength and flexural strength than the foam base. A front section may be made of the same blank material as the low density polyolefin foam base and is bonded to the front end of the foam core complex to give a full frontal flexibility for a higher directional control by the rider and an improved shock absorbing property.

Another example of modern improvements in surfboards comprises an improved bodyboard for use in the ocean surf, the improvements being a substantially vertical step in the lateral edges to increase the speed by allowing the water to shear off the side; a raised portion in the upper surface to provide greater leverage for the rider in controlling turns on the bodyboard; and a dimpled portion in the center thereof below the rider's body to provide both a lubricating effect and an adhesion effect between the rider's body and the bodyboard.

There is also a surfboard known that has a hollow inner volume which contains a longitudinally oriented reinforcement system or spine, with laterally arranged branches or ribs. The reinforcement system is spaced both from the nose of the surfboard and from the tail of the surfboard, while the ribs or branches radiate from the spine towards each side of the board in various spine and rib configurations to provide an optimal balance between weight, strength and flex.

None of the aforementioned developments teach the use of an elliptically contoured deck with domed center combined with an interior reinforcement system including a three or five stringer system that stiffens the deck while allowing the hull to remain flexible. Even though the above cited surfboards and methods address some of the needs of the market, a completely new and improved wave-riding device capable of offering to the rider a new set of possibilities by incorporating an elliptically contoured deck with domed center and a reinforcement system is still desired in the market.

SUMMARY OF THE INVENTION

None of the above cited surfboards, printed or online literature or technical background for surfboards suggest the possibility of including an elliptically contoured bevel with domed center cut into the board that allows the rider to have substantially more control over the way the board reacts on the wave. It is precisely the main object of the present invention to introduce a new concept that will change the surfboard concept forever, by including an elliptically contoured bevel with domed center cut into the deck together with a general reinforcement system through which a completely new wave-riding device is created.

This invention is directed to a new wave-riding device comprising a long narrow buoyant body including a front nose and a back tail, a bottom surface that rests on the water and a deck that is the surface of the board that the surfer stands on. On said deck generally-elliptical shaped bevels cut into the deck are included and at least one or more stringers or braces, consisting of longitudinal members to strengthen the structure of the board, are also an integral part of the board's body. The elliptically contoured deck with a domed center offers more control to the rider while paddling and riding.

In one general aspect of the present invention, the stiffening element is extended throughout the length of the purposed wave-riding device to provide an even stiffness to the structure.

Accordingly, it is a primary object of the present invention to provide a wave-riding device with a lower center of gravity, including an elliptically contoured area with a domed center and a stringer system which allows the rider to shift weight much easier, thereby making 'cuts' and 'digs' and 'tricks' quicker and more dramatic than on a typical surfboard.

Yet another aspect of the purposed invention comprises a wave-riding device which allows the rider to guide-steer the board while 'paddling, by having his/her body closer to the water, catch waves quicker/easier, more torso control, duck diving, flips and no slips.

In a further aspect of the present invention, the purposed wave-riding device allows the rider to stand up quicker because of the side-stops created by the elliptically countered deck, to make their 'drop-in' easier and faster on a better source of the wave. It also helps the rider to "feel" the center of the board with his/her feet and steer-guide while riding.

Yet another aspect provides a wave-riding device including a reinforcement system which will strengthen the elliptically contoured portion of the board. This stringer may be, but not limited to, a 'tri-stringer' system, a 'penta-stringer' system, a parabolic system or quad as will be explained in detail below.

Some of the advantage of the present invention may be summarized as:

a) The elliptically contoured with domed center board's body allows the rider to have substantially more control over the way the board reacts on the wave;
b) It allows the rider to shift weight much easier, thereby making quicker and more dramatic maneuvers than on a typical surfboard;
c) It allows the rider to have his/her body closer to the water, controlling the direction of the board with his/her torso because of the elliptically contoured with domed center, while paddling, allowing for a faster return to catch more waves quicker and easier;
d) The rider can stand up quicker to make his/her 'drop-in' easier and faster on a better part of the wave;
e) The rider can find the center of the board (feel) easily;
f) The entire body of the board is reinforced with a tri-, penta-, parabolic- or quad-stringer reinforcement system;
g) It has a lower center of gravity allowing a better body balance, stability and control when standing;
h) It provides hand grips on the sides of board which allow quicker stand-ups, dramatically less hand slippage, and tighter grips for easier 'Duck-Dives'; and
i) It helps prevent slipping and improper foot placement by providing built-in side stops, front stop, and back stop.

In summary, the present invention is related to a longitudinally reinforced wave-riding device comprising a long narrow buoyant body including a front nose and a back tail, a bottom surface that rests on the water and a deck on which the surfer stands; on said deck, an elliptical contoured bevel with domed center is included, and at least one stringer or brace, consisting of longitudinal members to strengthen the structure of the board, are also an integral part of the board's body.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF REPRESENTATIVE EMBODIMENTS

Figure 1:
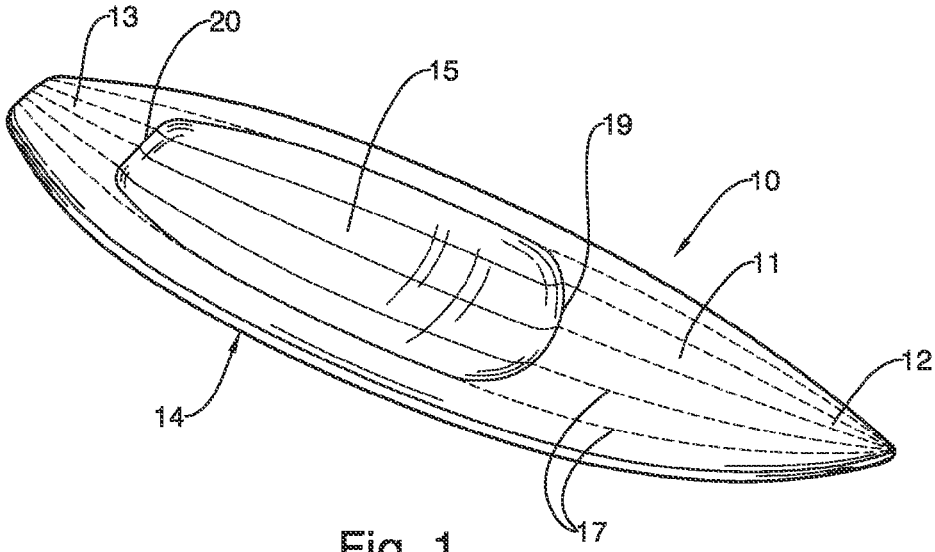
FIG. 1 is a general perspective view of a first embodiment of the wave-riding device of the present invention, including five longitudinal stringers in its structure and defining what is called a 'penta-stringer' reinforcement means.
Figure 2:
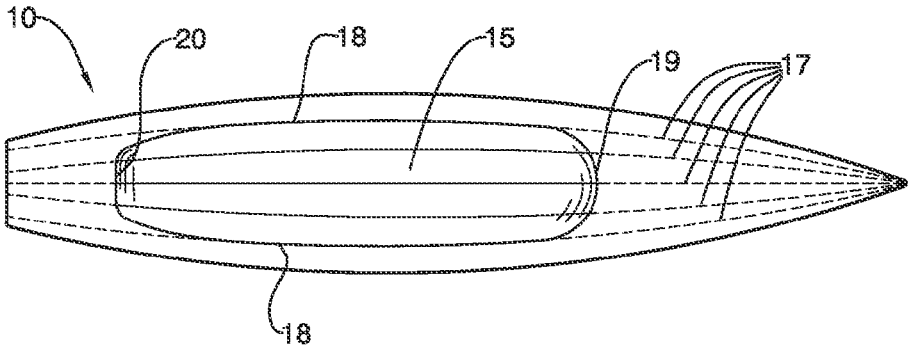
FIG. 2 is a top plan view of the embodiment of FIG. 1, showing in detail the general shape of the device and the elliptical contoured with domed center cut into the deck.
Figure 3:
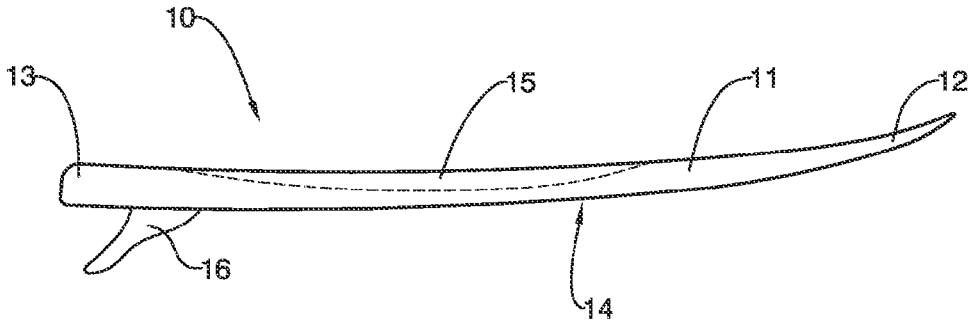
FIG. 3 is a side elevational view of the purposed longitudinally reinforced elliptical contoured with domed center wave-riding device.

Shown throughout FIGS. 1-3, the invention is directed to a wave-riding device 10 comprising a long narrow buoyant body including a front nose 12 and a back tail 13, a bottom surface 14 that rests on the water and a deck 11 on which the surfer stands. As usual, on said bottom surface 14 at least one (or more) fins 16 are also included.

In the first embodiment illustrated in FIGS. 1-3, on said deck 11 an elliptical contoured with domed center 15 is included, which in turn includes two longitudinal substantially parallel edges 18 connected by a frontal rounded end edge 19 and a shorter substantially straight back edge 20.

Between the tail 13 and the nose 12, a set of longitudinally oriented stringers 17 are embedded in the material used to manufacture said board 10. Said stringers define a rib-like reinforcement structure which basically strengthens the elliptical contoured with domed center cut into the board. In the present embodiment, the device includes 5 substantially parallel stringers, defining what is called 'penta-stringer' reinforcement means.

In the embodiment of FIGS. 1-3 the reinforcement structure includes five stringers defined as thin pieces of wood or other material running from nose 12 to tail 13 that increase the strength of the purposed wave-riding device. Since said stringers are incorporated into the body of the purposed device, they are integral with the foam with which the device is manufactured, providing a reinforcement where an elliptical contoured with domed center is cut out into the board. It is also important to point out that even though foam is the most popular material used to manufacture these boards, they may also be made of wood or other composite materials used in the surfing industry.

Figure 4:
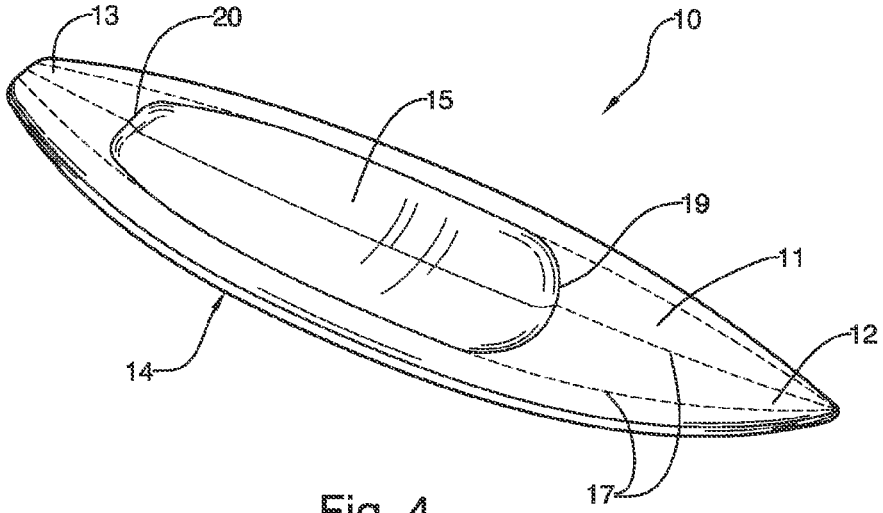
FIG. 4 is another general perspective view this time illustrating a second embodiment, in which the structure of the purposed device includes three longitudinal stringers instead of five, defining what is called a 'tri-stringer' reinforcement means.
Figure 5:
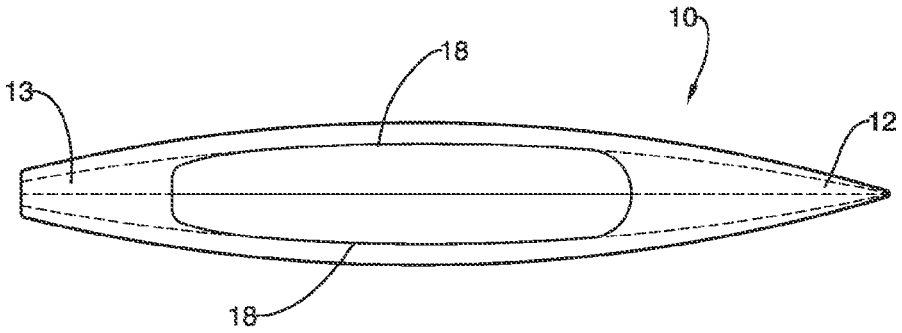
FIG. 5 is a top plan view of the embodiment of FIG. 4.
Figure 6:
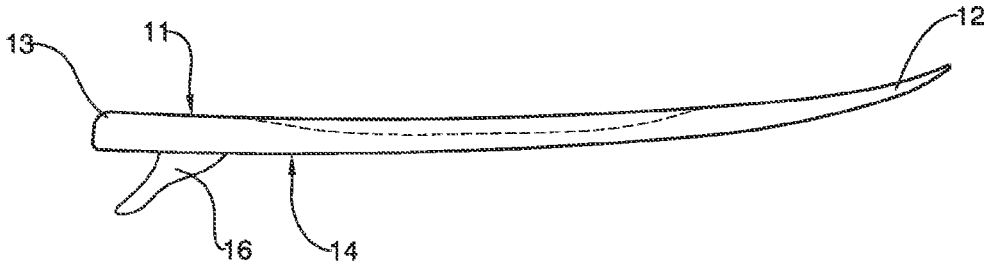
FIG. 6 is a side elevational view of the embodiment of FIG. 4.

In the embodiment illustrated in FIGS. 4-6 the purposed wave-riding device comprises essentially the same parts as described above but this time, instead of having five stringers 17, the device includes only three of them. There are several factors affecting the decision of how many stringers the device will include. Some of them are the foam used to manufacture the body, the relationship between the longitudinal and transversal dimensions, etc. In this embodiment, the device includes three substantially parallel stringers, defining what is called 'tri-stringer' reinforcement means.

Figure 7:
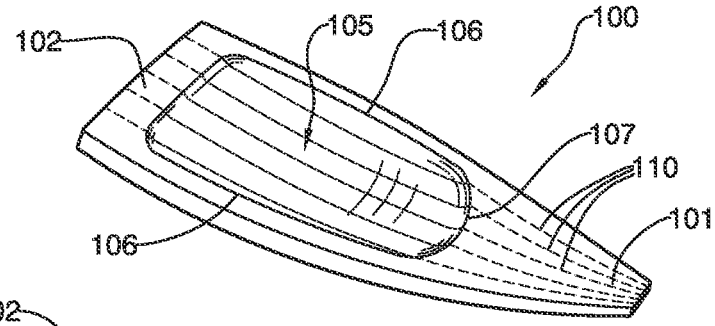
FIG. 7 is a general perspective view of another embodiment of the present invention, this time showing the elliptical contoured with domed center on a shortboard, including the penta-stringer concept explained in detail below.
Figure 8:
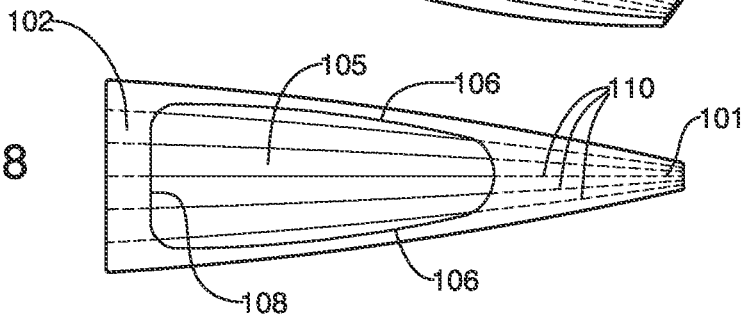
FIG. 8 is a top plan view of the embodiment of FIG. 7.
Figure 9:
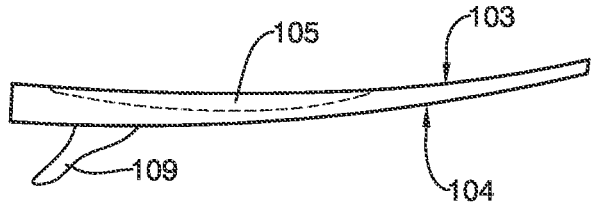
FIG. 9 is a side elevational view of the embodiment of FIG. 7.

In the embodiment illustrated in FIGS. 7-9 the wave-riding device 100 comprises a shortboard 100 including a front nose 101 and a back tail 102, a bottom surface 104 that rests on the water and a deck 103 on which the surfer stands. In this case, the body of the board is much shorter than in the previous embodiments. As usual, on said bottom surface 104 a fin (or more) 109 is also included. Fins are needed and can be configured in any of a wide variety of known configurations.

As in the previous cases, on said deck 103 an elliptical contoured with domed center 105 is included, with two longitudinal substantially parallel convex edges 106 connected by a frontal rounded end edge 107 and a longer substantially straight back edge 108. This time the elliptical contoured with domed center presents an irregular shape which follows the general tapered shape of the body 100.

Figure 10:
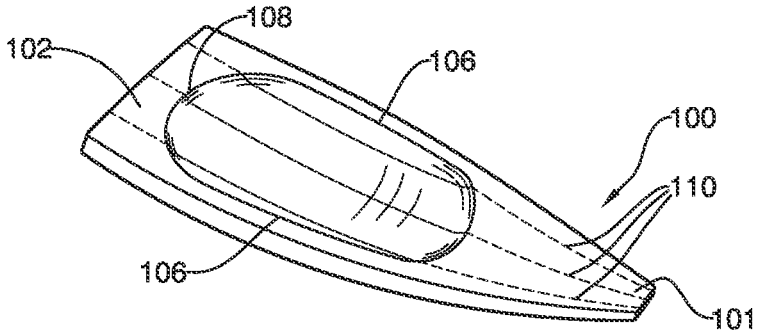
FIG. 10 is another perspective of the last embodiment of the purposed invention, with the elliptical contoured with domed center on the deck and the tri-stringer concept applied thereto.

Between said tail 102 and nose 101 a set of longitudinally oriented stringers 110 are also embedded in the material used to manufacture said body 100. In this embodiment, the board includes five longitudinal stringers 110 (following the penta-stringer concept explained above) and in the embodiment of FIGS. 10-12 only three are included (the tri-stringer concept).

Figure 11:
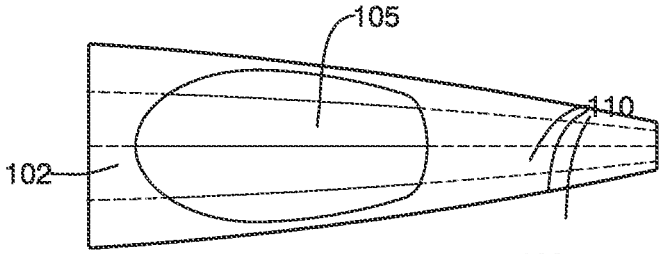
FIG. 11 is a top plan view of the embodiment of FIG. 10.
Figure 12:
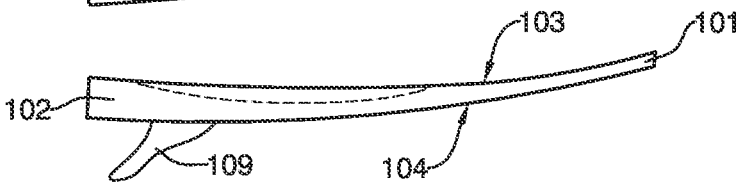
FIG. 12 is a side elevational view of the embodiment of FIG. 10.

As clearly seen in FIGS. 8 and 11, in these embodiments the wave-riding device 100 includes two straight parallel end edges defining the nose 101 and tail 102, connected by two lateral angled lateral edges 106, defining together a geometric design. Nevertheless, this should not be considered a limitation to the purposed invention as any other shape for the bevel may be used without departing from the general concept purposed of having an elliptical contoured with domed center cut into the deck and reinforcing stringers as part of the structure.

Figure 13:
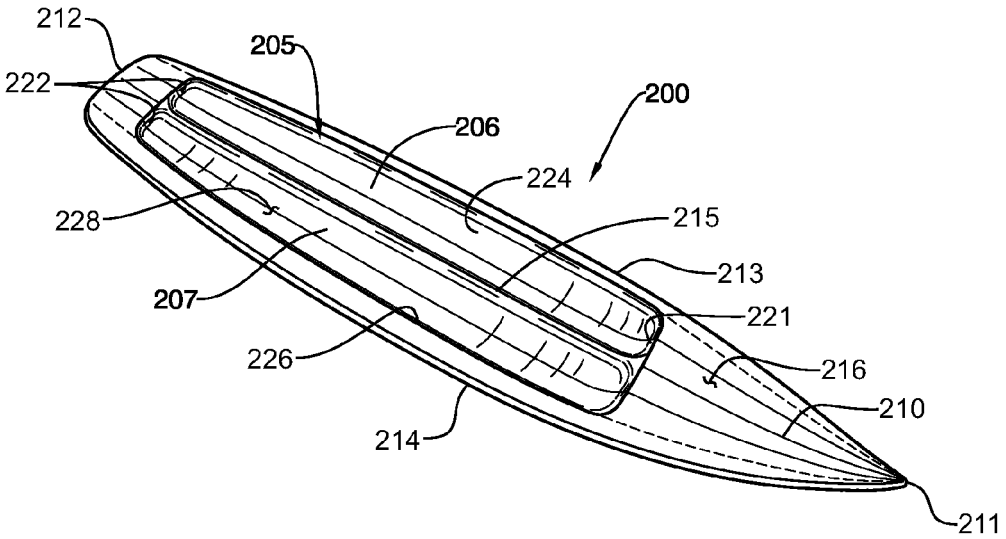
FIG. 13 is another perspective view of another embodiment in which the board includes an elliptical contoured with domed center cut into the deck.
Figure 14:
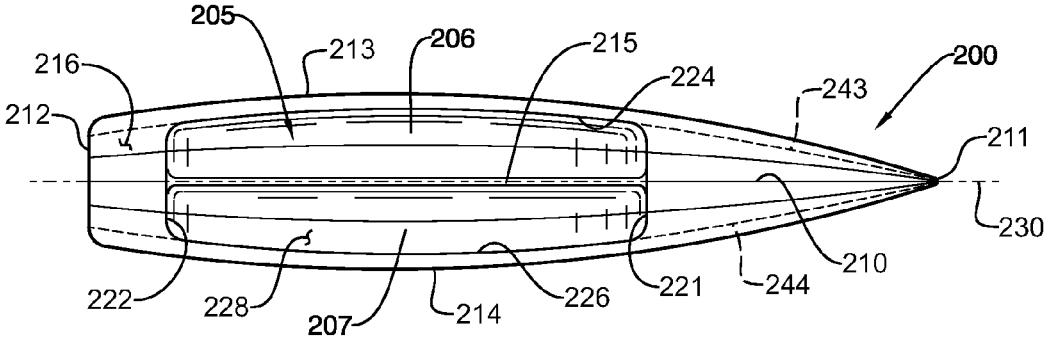
FIG. 14 is a top view of the embodiment of FIG. 13.
Figure 15:
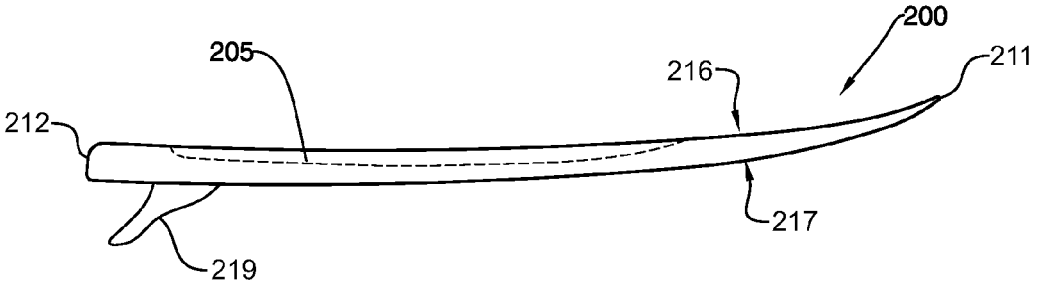
FIG. 15 is a side elevational view of the embodiment of FIG. 13.

FIGS. 13-15 show another embodiment in which the board 200 includes a central stringer 210 that protrudes from the surface of the elliptical contoured with a recessed cavity 205. This way, the stringer defines portions 206-207.

The board 200 includes an elliptically shaped deck surface 216 and an opposite bottom surface 217. the deck surface 216 and bottom surface 217 are bound by a front nose 211 at a leading end of the board 200, a back or rear tail 212 along a trailing end of the board 200, a first side rail 213 extending along a first edge of the board 200 between the front nose 211 and the back tail 212, and a second side rail 214 extending along an opposite, second edge of the board 200 between the front nose 211 and the back tail 212.

The recessed cavity 205 extends downward from the deck surface 216, terminating at a basin surface 228. The recessed cavity 205 is bound or defined by a front recessing edge 221 extending generally perpendicular to a centerline 230 of the board 200, a first recessing edge 224 running proximate and parallel to the first side rail 213, a second recessing edge 226 running proximate and parallel to the second side rail 214, and a tail recessing edge 222 running proximate and parallel to the back tail 212. The tail recessing edge 222 can be shorter than the front recessing edge 221.

The recessed cavity 205 is segmented into at least two sections 206, 207 by a central stringer 210, defining a central ridge 215. The central ridge 215 protrudes upwards from the basin surface 228, segmenting the recessed cavity 205 into two generally similar, symmetric sections. The central ridge 215 extends continuously between the front recessing edge 221 and the tail recessing edge 222.

A pair of outside stringers comprising a first outside stringer 243 and a second outside stringer 244 define a parabolic shape of the elongated body.

Besides the regular functions the surfer can perform with the purposed wave-riding system it is also possible to perform new functions including Front-Stop, Back-Stop, Side-Stops and Grips. Also the board may include any number of elliptical contours with domed center, different shapes and sizes, including longboards, wakeboards, kneeboards, or any other riding devices.

While the preferred embodiments of the invention have been described above, it will be recognized and understood that various modifications can be made in the invention and the appended claims are intended to cover all such modifications which may fall within the spirit and scope of the invention.

We claim:

1. A longitudinally reinforced elliptically contoured wave-riding board comprising:

an elongated body having an elliptically shaped deck surface and an opposite bottom surface bound between a front nose, a back tail, a first side rail extending along a first edge of said elongated body between said front nose and said back tail, and a second side rail extending along a second, opposite edge of said elongated body between said front nose and said back tail, said elongated body being generally symmetric about a centerline thereof;

a recessed center section extending downward from a surface of said elliptically shaped deck surface, said recessed center section defined by a front recessing edge extending generally perpendicular to said elongated body centerline, a first rail recessing edge being parallel and adjacent to said first side rail, a second rail recessing edge being parallel and adjacent to said second side rail, and a tail recessing edge being parallel and adjacent to said back tail;

a central ridge extending upwards from a basin of said recessed center section and extending continuously between said front recessing edge and said tail recessing edge along said body centerline, said central ridge segmenting said recessed center section into two substantially equal recessed subsections, each one of said recessed subsections having substantially uniform depth and width between said front recessing edge and said tail recessing edge;

a fin extending downward from said bottom surface; and at least one stringer as an integral part of said body, wherein said at least one stringer is a longitudinal member capable of strengthening said structure thereof; said stringer extending between said front nose and said back tail.

2. The longitudinally reinforced elliptically contoured wave-riding board of claim 1, wherein said recessed center section is formed as an elliptically contoured area cut out into said deck.

3. The longitudinally reinforced elliptically contoured wave-riding board of claim 1, further comprising at least one additional fin extending downward from said bottom surface.

4. The longitudinally reinforced elliptically contoured wave-riding board of claim 1, said at least one stringer further comprises a set of longitudinally oriented stringers, wherein said set of longitudinally oriented stringers are embedded in a material of said body.

5. The longitudinally reinforced elliptically contoured wave-riding board of claim 4, wherein each of said set of longitudinally oriented stringers define a rib-like reinforcement structure strengthening said elliptically contoured deck portion of said elongated body.

6. The longitudinally reinforced elliptically contoured wave-riding board of claim 4, wherein each of said set of longitudinally oriented stringers comprise a thin piece of wood running from said nose to said tail.

7. The longitudinally reinforced elliptically contoured wave-riding board of claim 4, said set of longitudinally oriented stringers comprises 2 to 5 substantially parallel stringers.

8. The longitudinally reinforced elliptically contoured wave-riding board of claim 4, wherein one of said set of longitudinally oriented stringers is located along said centerline of said body.

9. The longitudinally reinforced elliptically contoured wave-riding board of claim 8, wherein a central stringer of said set of longitudinally oriented stringers forms said central ridge projecting above said basin surface of said recessed center section, defining two lateral recessed sections.

10. The longitudinally reinforced elliptically contoured wave-riding board of claim 4, wherein a set of outside stringers of said set of longitudinally oriented stringers defining a parabolic shape of said body.

11. The longitudinally reinforced elliptically contoured wave-riding board of claim 1, wherein said body is fabricated of a foam material.

12. The longitudinally reinforced elliptically contoured wave-riding board of claim 1, wherein said body is fabricated of wood.

13. The longitudinally reinforced elliptically contoured wave-riding board of claim 1, wherein said body has a tapered shape.

14. The longitudinally reinforced elliptically contoured wave-riding board of claim 1, wherein said front nose is formed having a pointed nose and said back tail is formed having a straight cut-out tail.

* * * * *